United States Patent [19]

Neal

[11] 3,943,354

[45] Mar. 9, 1976

[54] MULTIPLE PURPOSE LOW VOLTAGE SEALED BEAM LAMP

[75] Inventor: Kathleen T. Neal, York, Pa.

[73] Assignee: Penguin Pools, Inc., York, Pa.

[22] Filed: Aug. 9, 1974

[21] Appl. No.: 459,296

[52] U.S. Cl. ..... 240/26; 240/52.2

[51] Int. Cl.[2] ..... F21V 31/00

[58] Field of Search..... 240/26, 8.14, 52.2, 54 R, 240/54 A, 8.2, 8.3, 1.2; 174/52 PE

[56] References Cited

UNITED STATES PATENTS

| | | | |
|---|---|---|---|
| 1,064,515 | 6/1913 | Miller | 240/8.3 |
| 1,933,511 | 10/1933 | Manson | 240/26 |
| 2,757,276 | 7/1956 | Campbell | 240/26 |
| 2,812,423 | 11/1957 | Penna | 240/52.2 X |
| 2,931,895 | 4/1960 | Wagenhauser | 240/26 X |
| 3,349,232 | 10/1967 | Robertson et al. | 174/52 PE |
| 3,801,812 | 4/1974 | Palumbo et al. | 240/26 X |

*Primary Examiner*—Robert P. Greiner
*Attorney, Agent, or Firm*—Wilfred G. Caldwell

[57] ABSTRACT

Apparatus for illuminating under water without ground fault interrupters comprising a 12-volt sealed beam lamp, electrical cord, and cigarette lighter plug for powering from the electrical system of a vehicle. A housing is recessed to receive the lamp and two types of sealers, one sealing the terminals and the other generally filling the void between the lamp and recess. A threaded stud with threaded fastener and washer is embedded in the void filling material and penetrates the housing to receive a vacuum cup suitable for holding the lamp on the side or bottom of a pool.

2 Claims, 3 Drawing Figures

MULTIPLE PURPOSE LOW VOLTAGE SEALED BEAM LAMP

The present invention is a versatile lighting arrangement primarily intended for use with swimming pools, either above ground or under water.

The invention includes a low voltage, preferable 12-volt sealed beam lamp of the type used for vehicle headlights mounted in a plastic housing and equipped with an extension cord terminating at a cigarette lighter plug so that the light may only be powered from a vehicle battery. This avoids the requirement for ground fault interrupters and other safety devices required by safety regulations, while providing a totally acceptable source of illumination without hazard regardless whether it is located above or below the water line.

Several factors cooperate to insure a water-tight arrangement, avoiding short circuiting when the lamp is used under water. First, a sealed beam light is used with its exposed terminals connected to the electrical cord and the junction thereof sealed by silicone caulking or the like. This is a rubbery like material that adheres well to the glass, metal, and cord while maintaining its flexibility. A further sealer in the form of phenolic resin, or the like, which sets up over the silicone caulking, generally fills in the void between the lamp and recess, serving to form a rigid coupling of the light to housing.

The second sealer of filler also serves a further purpose in supporting a portion of a threaded stud for positive attachment of the lamp to the housing while providing a convenient protruding threaded portion to which a vacuum cup is threadably engaged, providing a verstile means of attachment of the lamp to the walls or floor of a pool, even including those having vinyl liners.

A threaded fastener is screwed onto the stud near one end and embedded in the resin before it hardens. A washer is placed against the threaded fastener or spaced therefrom but disposed to contact the lowest portion of the recess internally about an aperture provided for the extending portion of the threaded stud. A tightening of the vacuum cup onto the threaded extension outside of the housing serves to secure the configuration together and also to provide an axially aligned support. The cord extends through the two sealers and also penetrates the housing to exit therefrom near the bottom of the recess with the vacuum cup providing a clearance between the lower portion of the housing and the wall, floor or ground supporting the lamp for the cord in order to permit the lamp to assume a vertical or horizontal position without resting on the cord.

The housing is preferably circular with a peripheral flange tapering slightly outwardly and a recess deeper than the light to permit the sealers and other structure snugly to fit therein so that the lip of the housing recess forms a rim of the light. The material of the housing is preferably plastic for ease of fabrication and durability.

Figure 1:
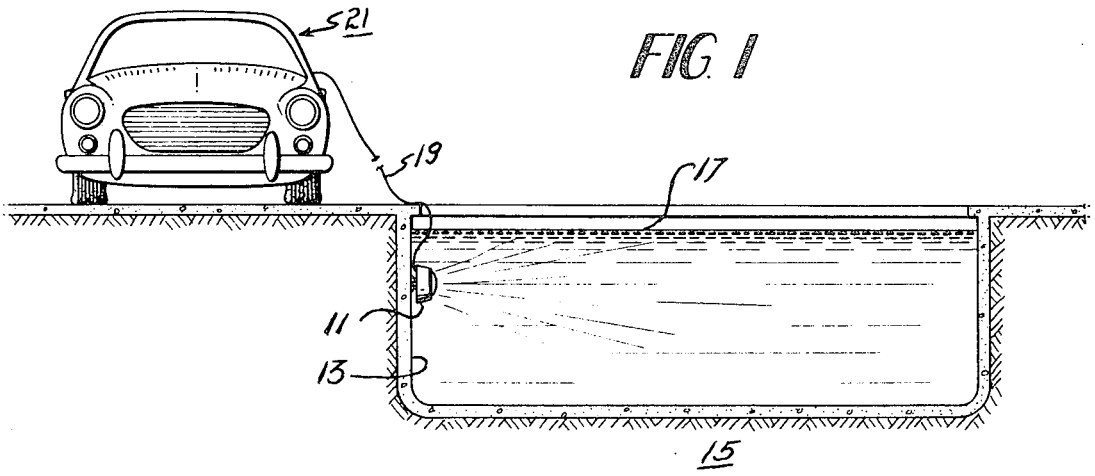
Figure 2:
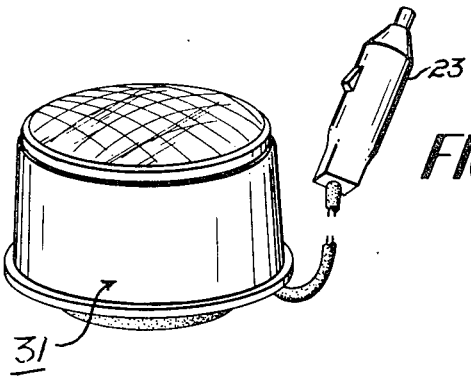
Figure 3:
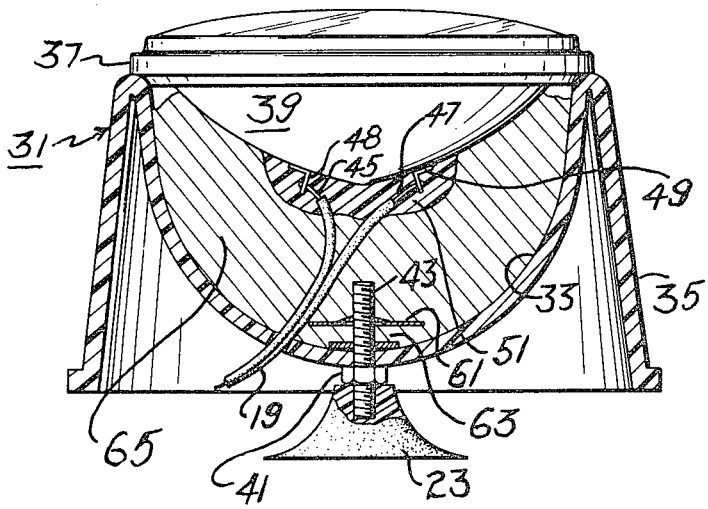

The invention will further be described in detail, reference being had to the accompanying drawings wherein:

FIG. 1 is a sectional view of a pool showing the light affixed to a vertical wall under water and the extension cord running to a vehicle, FIG. 2 is a view in perspective of the illuminating apparatus of the present invention, and FIG. 3 is a view of the low voltage lamp in side elevation with the supporting and connecting structure partly in section and partly in elevation.

In FIG. 1, the lamp 11 is shown sticking to the vertical wall 13 of pool 15 beneath the water level 17. The electrical cord 19 extends to the vehicle 21 for attachment of the cigaret lighter plug 23 (FIG. 2) in the cigarette lighter socket of the vehicle. The cord is preferably 75 feet or more in length so that vehicle 21 may even be housed in an adjacent garage and the cord extended there.

Although the pool 15, depicted in FIG. 1, is shown with a concrete wall 13 it will be appreciated that the vacuum cup 23 (FIG. 3) will adhere to either vinyl liners or concrete sides or other structures.

The light 11 is thus a self-contained unit which permits the average pool owner to install it themselves either beneath the water line 17, adjacent the pool, on their boats, or wherever desired. Since it operates from the vehicle batteries, there are no extra batteries to buy and it is economical to use. The cigarette lighter plug 23 insures that the lamp cannot be plugged into 110-volts thereby avoiding the necessity for ground fault interrupters and other complicated safety devices.

For extended periods of use, the vehicle may be idled for a period to recharge its own battery and the modern alternator is particularly capable of quickly replenishing the slight current drawn. It has been found that car batteries in reasonable condition are not harmed by as much as 6 to 8 hours of continuous lamp use and actually the lamp has been used as much as 30 hours continuously without damage to the vehicle electrical system or battery. It is also useful for emergency lighting, including tire changing and other repairs because it is so compact and can easily be carried in the automobile.

The water-proofing and supporting structure is best seen in FIG. 3, wherein the plastic housing 31 includes a circular recess 33 and a peripheral flange 35. The rim 37 of the sealed beam light 39 rests on the lip of recess 33, being drawn snugly thereagainst by vacuum cup 23 or nut 41 drawing stud 43 downwardly.

Also from FIG. 3 it may be seen that the cord 19 includes the wires 45 and 47, respectively connected to the light terminals 48 and 49. This junction is covered by sealing material 51, such as silicone caulking to prevent any water from reaching the bare wires 45 and 47.

The stud 43 receives a threaded fastener 61 and a washer 63 within the recess 33 with the stud penetrating the housing 31 axially of the circular mouth thereof to receive nut 41 and vacuum cup 23. Nut 41 can of course be incorporated in the vacuum cup 23 if the latter is suitably threaded. The stud 43 is anchored to the structure by virtue of the resin filler 65 between light 30 and the wall of recess 33, preferably phenolic resin is used as it sets up and hardens to unite the structure, sticking to the glass of lamp 39, as well as to stud 33 and associated components. It also covers the caulking 51 and serves as a further waterproofing seal.

The cord 19 exits from the housing 31 via an aperture in recess 33 and it may be seen that the spacing between the point of attachment of cup 23 and the lower edge of the housing 31 enables the cord to pass freely beneath the housing without interfering with the attachment.

In the event that it is desirable to energize the lamp from a 12 volt battery, rectifier, or other source, conventional spring clips may be substituted for the cigarette lighter for attachment to the respective terminals of such conventional sources.

What is claimed is:

1. Apparatus for illuminating regions including underwater regions without ground fault interrupters comprising in combination, a low-voltage sealed beam lamp and electrical cord combination;

a cigarette lighter plug connected to the end of the electrical cord remote from said lamp, and adapted for plug-in connection with the cigarette lighter socket of a vehicle;

a housing for the lamp including a recess contoured to receive the lamp and having a depth in excess of the depth of the lamp;

means sealing the junction of the cord and lamp;

means filling the excess space in the housing between the lamp and wall of the recess;

said housing including an aperture, and said cord extending through the filling means and said aperture to exit from the housing;

a threaded stud;

a threaded fastener carried by the stud;

a washer carried by the stud in spaced relation to the fastener;

said fastener, washer and a portion of the stud being embedded in the filling means with the stud other than said portion extending outwardly of the filling means and penetrating the recess wall and extended therebeyond; and, a suction cup carried by the extending end of the stud.

2. The apparatus of claim 1 wherein the washer is disposed within the recess and against the inner side of the recess wall; said housing comprising a substantially circular peripheral flange about the recess, and the suction cup being axially located relative to the flange.

* * * * *